US008112846B2

(12) United States Patent
Wong et al.

(10) Patent No.: US 8,112,846 B2
(45) Date of Patent: Feb. 14, 2012

(54) CLEAT FOR SECURING PACKAGING TIES

(75) Inventors: Michael Wong, Harbour (HK); John Yang, Shen Zhen (CN); Reed Nie, Shen Zhen (CN); Jimmy Li, Harbour (HK)

(73) Assignee: Mattel, Inc., El Segundo, CA (US)

( * ) Notice: Subject to any disclaimer, the term of this patent is extended or adjusted under 35 U.S.C. 154(b) by 583 days.

(21) Appl. No.: 11/897,396

(22) Filed: Aug. 29, 2007

(65) Prior Publication Data

US 2008/0216293 A1 Sep. 11, 2008

(30) Foreign Application Priority Data

Mar. 8, 2007 (CN) ..... 2007 1 0086062
Jun. 5, 2007 (CN) ..... 2007 1 0108559

(51) Int. Cl.
*F16G 11/04* (2006.01)

(52) U.S. Cl. ..... 24/130; 24/18

(58) Field of Classification Search ..... 24/129 R, 24/130, 129 B, 712.9, 18, 114.7; 606/232; 206/478; 114/218
See application file for complete search history.

(56) References Cited

U.S. PATENT DOCUMENTS

| | | | | |
|---|---|---|---|---|
| 703,018 | A | | 6/1902 | Thomas |
| 749,847 | A | | 1/1904 | Curtis |
| 760,428 | A | | 5/1904 | Cross |
| 835,656 | A | * | 11/1906 | Amann ..... 24/18 |
| 1,020,963 | A | | 3/1912 | Cake |
| 1,151,058 | A | * | 8/1915 | Sparks ..... 24/18 |
| 1,242,156 | A | | 10/1917 | Dousel |
| 1,247,479 | A | * | 11/1917 | Zepp ..... 24/18 |
| 1,251,778 | A | * | 1/1918 | Humble ..... 24/130 |
| 1,806,162 | A | | 5/1931 | Hahn |
| 2,151,664 | A | | 3/1939 | Erwin |
| 2,220,366 | A | | 11/1940 | Fly |
| 3,409,014 | A | | 11/1968 | Suel |
| 3,678,543 | A | | 7/1972 | Hobbs |
| 3,721,750 | A | | 3/1973 | Countryman |
| D243,655 | S | | 3/1977 | Matousek et al. |
| 4,034,443 | A | | 7/1977 | Turner |
| 4,188,435 | A | | 2/1980 | Bartrug |
| D287,097 | S | * | 12/1986 | Nelson ..... D8/382 |
| 5,519,921 | A | | 5/1996 | Templer, Jr. |
| 5,527,341 | A | | 6/1996 | Gogolewski et al. |
| 5,642,556 | A | | 7/1997 | Alexander |
| D410,374 | S | | 6/1999 | Meurer |
| 5,979,028 | A | | 11/1999 | Hicks et al. |
| 6,763,776 | B1 | * | 7/2004 | Perri et al. ..... 114/218 |
| 6,928,704 | B2 | * | 8/2005 | Johnson ..... 24/130 |
| D516,898 | S | * | 3/2006 | Amy ..... D8/356 |
| 7,150,757 | B2 | | 12/2006 | Fallin et al. |

OTHER PUBLICATIONS

State Intellectual Property Office of the P.R.C., Office Action for Application No. 200710108559.6, Sep. 28, 2011, 7 pages.

* cited by examiner

*Primary Examiner* — James Brittain
(74) *Attorney, Agent, or Firm* — Kolisch Hartwell, PC

(57) ABSTRACT

Cleats configured to retain objects secured with a packaging tie in association with packaging material.

11 Claims, 5 Drawing Sheets

CLEAT FOR SECURING PACKAGING TIES

BACKGROUND

A variety of devices and techniques have been employed to secure packaged items. For example, packaged items may be secured by molded foam or inflated cushions, but are often secured to a backing sheet with one or more securing devices. Previous securing devices have often included coated flexible wires, or "packaging ties." For example, in the case of packaged toy 10 of FIG. 1, a toy FIG. 12 is secured to a backing sheet 14 in a display box 16. FIG. 12 is secured to backing sheet 14 with multiple packaging ties 18. The ends of the packaging ties protrude from the rear surface of backing sheet 14, as shown in FIG. 2. In order to remove the toy figure from the packaging, the backing sheet must be removed from display box 16, but then each of the packaging ties must be untwisted, and pulled through the backing in order to free the figure. This process can be both frustrating and time-consuming, particularly for small children. Additionally, the packaging ties require time and attention to apply during packaging.

Clips and fasteners having various configurations have been previously described, for example in U.S. Pat. No. 835,656, U.S. Pat. No. 1,806,162, U.S. Pat. No. 5,979,028, and U.S. Pat. No. 6,928,704, all of which are hereby incorporated by reference for all purposes.

The advantages of the cleats of the present disclosure will be understood more readily after a consideration of the drawings and the Description of Preferred Embodiments. The cleats of the present disclosure may be inexpensively produced, and facilitate the use of packaging ties so that they may be quickly and easily applied during packaging, and can be removed easily, even by children.

DESCRIPTION OF PREFERRED EMBODIMENTS

Figure 1:
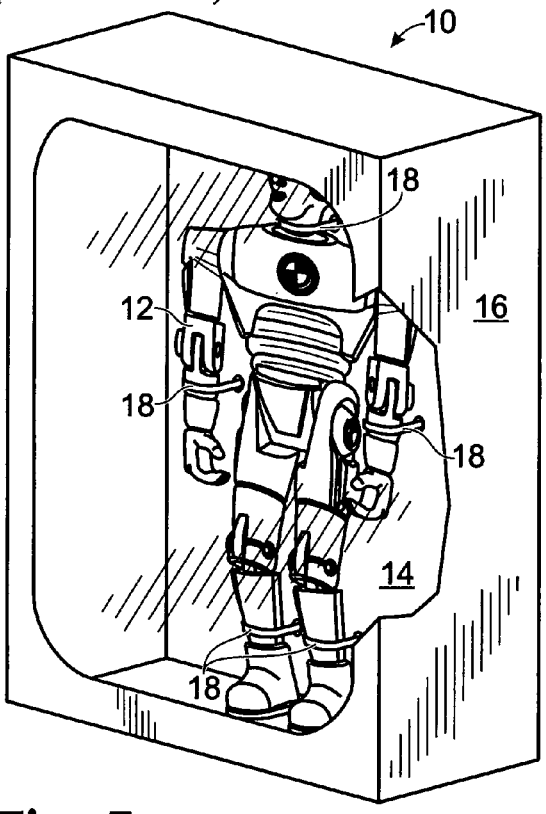
Fig. 1 (PRIOR ART)
FIG. 1 is an isometric cutaway view of a packaged toy figure according to the prior art.
Figure 2:
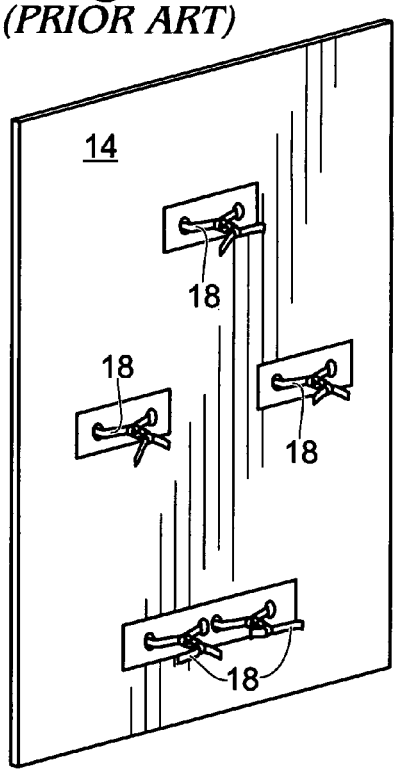
Fig. 2 (PRIOR ART)
FIG. 2 is an isometric view of the rear of the backing sheet of the packaged toy figure of FIG. 1.
Figure 3:
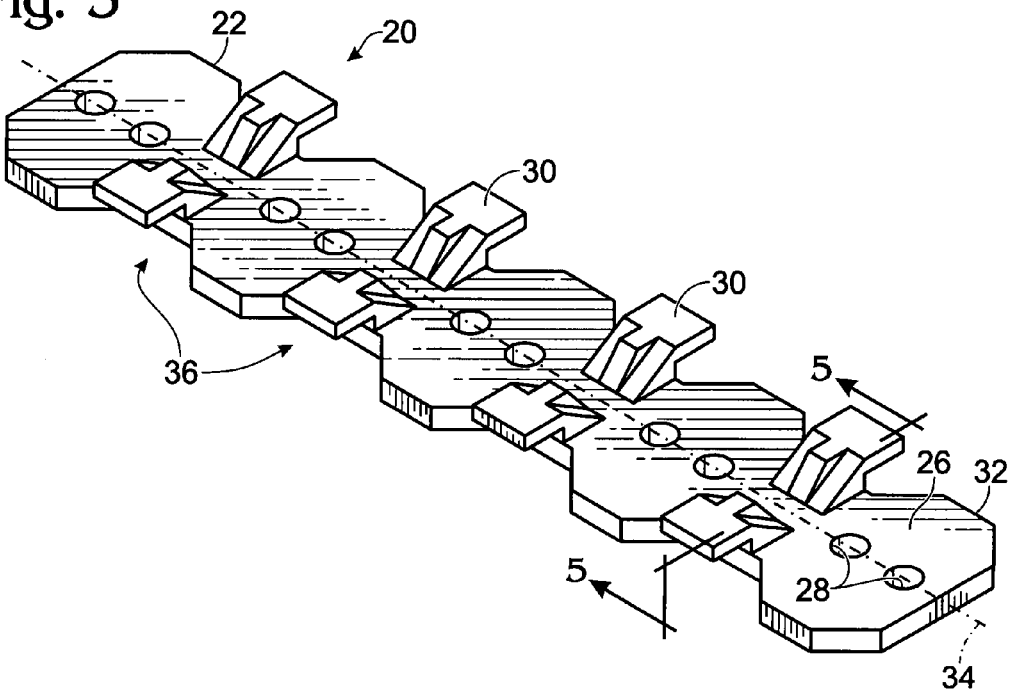
FIG. 3 depicts an isometric view of the upper surface of an exemplary cleat.
Figure 4:
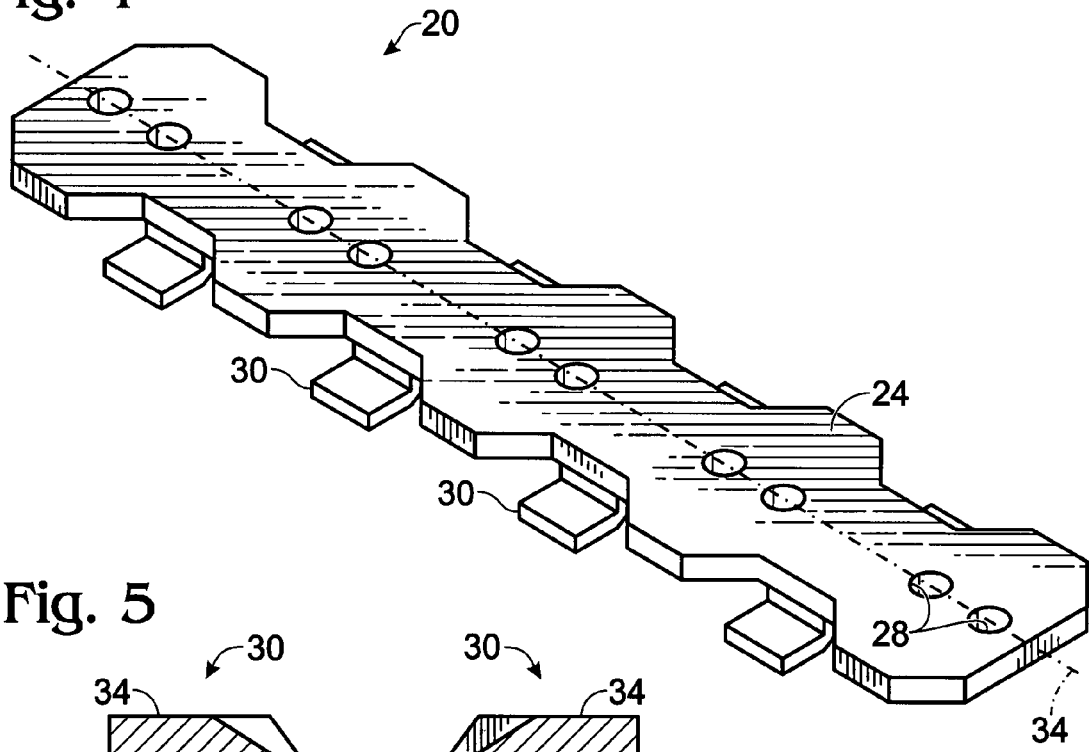
FIG. 4 depicts an isometric view of the undersurface of the exemplary cleat of FIG. 3.

The present invention provides embodiments of cleats configured to secure objects to packaging materials in combination with a packaging tie. An exemplary cleat 20 is shown in FIGS. 3 and 4. Cleat 20 is substantially planar, and includes a cleat body 22 having a flat undersurface 24, and an upper surface 26. The cleat body defines a plurality of apertures 28 therein. The upper surface also includes a plurality of lugs 30. Lugs 30 may be disposed anywhere on the upper surface of the cleat body, but are typically disposed in proximity to one or more of the apertures 28. In a particular embodiment of the cleat, the lugs are disposed on or near a perimeter 32 of the upper surface of the cleat body. Cleat 20 is generally configured so that a packaging tie may be inserted upwardly through an aperture in the cleat body, and secured by wrapping around or under an adjacent lug.

The cleat body 22 is typically substantially planar, and may be elongated, for example so that it extends along a longitudinal axis 34. The cleat body may exhibit a variety of symmetries, including mirror symmetry with respect to a vertical plane that includes the longitudinal axis. The cleat may be mirror-symmetric with respect to a plane perpendicular to the longitudinal axis, or it may be asymmetric with respect to the same axis. In one embodiment, the cleat body is generally rectangular, truncated rectangular, and/or rectangular with concavities or indentations along the cleat periphery.

The undersurface 24 of the cleat body is typically substantially flat, so that during use, the cleat may be placed flush against selected packaging materials. The undersurface 24 of exemplary cleat 20 is shown in FIG. 4. Although the cleat may be held in place sufficiently well by tension applied via an engaged packaging tie, additional methods of enhancing retention of the cleat in place may also be employed. For example, the cleat may be affixed to the packaging material using an adhesive, by thermal or chemical welding, or by mechanical attachment, among other methods. In an exemplary application, the cleat may be secured to the packaging material by an adhesive on the underside of the cleat. Alternatively, or in addition, the entire cleat may be taped in place, for example, after the packaging tie has been secured.

In one aspect of the disclosed cleat, the underside of the tie-down includes one or more protrusions which may be configured to enhance the attachment of the cleat to the desired packaging material. Such protrusions may have any suitable shape in order to positively interact with the packaging material. For example, the protrusions may be pin- or peg-shaped, hemispherical, conical, or frustoconical, so that the protrusions can be embedded partially into a suitably yielding packaging material, such as cardboard. In particular, the protrusions may be conical, and there may be a plurality of protrusions on the undersurface of the tie-down, which may be disposed near the corners or edges of the cleat undersurface. Tensioning the packaging tie may establish or enhance an attachment of the cleat against a piece of packaging material, by urging the protrusions into engagement with the surface of the packaging material.

The cleat body typically defines a plurality of apertures, through which a packaging tie may be threaded. Typically, each aperture is circular; however, any configuration of aperture that permits a packaging tie to be readily inserted and threaded therethrough is a suitable configuration for the purposes of this disclosure. For example, a raised lip may surround one or more apertures in the cleat body. A selected aperture may be rectangular in shape, with square ends, or with ends that may be more or less rounded. A selected aperture may be a substantially narrow, thereby forming a slit. The side walls that define the aperture may be straight and parallel, or the aperture opening may be chamfered (beveled) on one or both sides to improve the ease of threading a packaging tie through the slit. Depictions of apertures in the cleats of the present disclosure should be understood to include apertures of other shapes and sizes, that may include features for facilitating threading, enhancing retention, or both. The apertures on a given cleat may be substantially identical, or there may be variety of shapes and/or sizes of aperture on a single cleat, in order to make a cleat that is useful with a variety of sizes and types of packaging ties.

Figure 5:
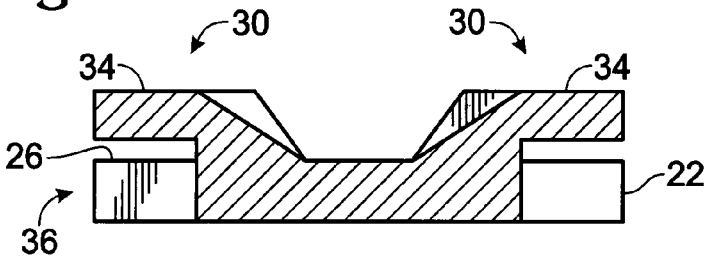
FIG. 5 depicts a cross-sectional view of the exemplary cleat of FIGS. 3 and 4, taken on the line 5-5 in FIG. 3.

The upper surface 26 of the cleat body is typically planar, with the exception of a plurality of lugs 30 disposed thereon. By "lug" is meant a projection configured to be used to securely and reversibly engage a segment of a packaging tie. The lugs 30 of cleat 20 incorporate a hook shape that may facilitate engagement of the packaging tie. More specifically, the upper portion 34 of each lug is cantilevered, as shown in FIG. 5, permitting a packaging tie to be routed beneath the cantilevered portion of the lug. The cantilevered portion is shown to project outwardly from the longitudinal axis of the cleat; that is, they project toward the periphery of the cleat. In one embodiment of the cleat, the cantilevered portion of the lugs projects beyond the periphery 32 of the cleat body. In another embodiment of the cleat, the lugs are disposed in opposing pairs, each projecting in opposite directions beyond the periphery of the cleat body. That is, the cleat may be configured so that the lugs are disposed in back-to-back pairs, as shown in the embodiment of FIGS. 3-5.

Where the cantilevered lugs project beyond the periphery of the cleat body, they may project beyond a peripheral edge that is substantially even, or they may project beyond a concavity in the periphery. In one embodiment of the disclosed cleat, as shown in FIGS. 3-5, each lug projects over a corresponding concavity 36 in the periphery of the cleat body. In the case of cleat 20, each concavity has a depth that substantially corresponds to the length of the projecting portion of the lug, but the corresponding concavity has divergent sides, resulting in the concavity being wider at the end of the projecting lug than the lug itself. This configuration may facilitate the passage of a segment of a packaging tie beneath the projecting portion of the lug, and yet still permit the packaging tie to be securely retained by the lug.

Figure 6:
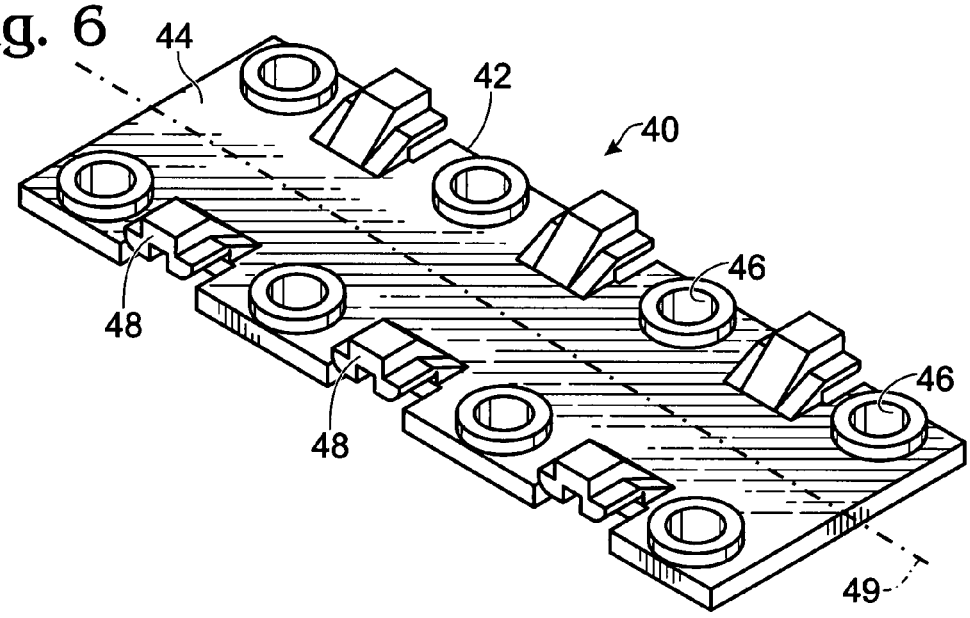
FIG. 6 depicts an isometric view of the upper surface of an alternative exemplary cleat.

Cleat 40 is an alternative embodiment of the cleat of the disclosure, as shown in FIG. 6. Cleat 40 also includes a cleat body 42, having an undersurface (not shown), an upper surface 44, a plurality of apertures 46, and a plurality of lugs 48. In contrast to cleat 20, the apertures 46 of cleat 40 are not disposed along the longitudinal axis 49 of the cleat, but are rather disposed in pairs along the cleat, each pair being symmetrically disposed with respect to the longitudinal axis. More particularly, the apertures 46 of cleat 40 are shown to be disposed near the periphery of the cleat body. Similar to the embodiment of FIGS. 3-5, however, the lugs of cleat 40 are also disposed in opposing back-to-back pairs.

Figure 7:
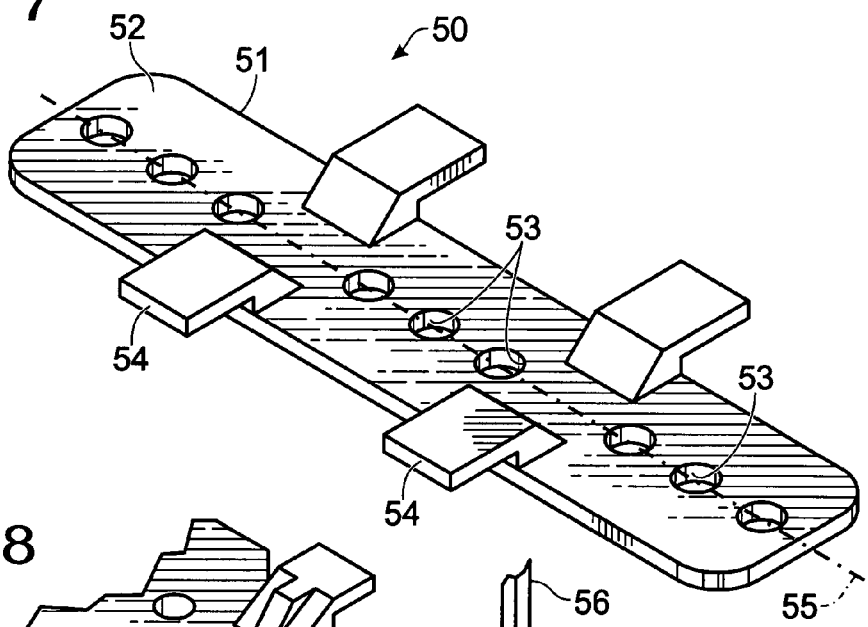
FIG. 7 depicts an isometric view of the upper surface of an alternative exemplary cleat.

Cleat 50 is yet another alternative embodiment of the cleat of the disclosure, as shown in FIG. 7. Cleat 50 includes a cleat body 51, having an undersurface (not shown), an upper surface 52, a plurality of apertures 53, and a plurality of lugs 54. Similarly to cleat 20, the apertures 53 of cleat 50 are disposed along the longitudinal axis 55 of the cleat. The lugs 54 of cleat 50 are disposed in opposing back-to-back pairs, similar to the embodiments of FIGS. 3-6. Lugs 54, however, project beyond a peripheral edge that is substantially even, with no corresponding concavity in the periphery.

Although the present disclosure refers to exemplary cleats that are roughly rectangular in outline, and have a defined number of apertures and lugs, a variety of alternative and exemplary cleats that utilize the same operating principle can be envisioned.

The cleats disclosed herein may be fabricated from any suitable material, or combination of materials, such as plastic, foamed plastic, wood, cardboard, pressed paper, metal, or the like. A suitable material may be selected to provide a desirable combination of weight, strength, durability, cost, manufacturability, appearance, safety, and the like. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, or the like. Suitable foamed plastics may include expanded or extruded polystyrene, or the like. The cleat itself may be fabricated from ABS, copolymers of polypropylene-copolymer (PP-co), high-impact polystyrene (HIPS), or phosphorylcholine (PC) polymers.

Any suitable molding or manufacturing process may be used to prepare the disclosed cleats. In particular, the disclosed cleats may be manufactured by a molding process, for example injection molding. The injection molding process may produce a molded array of cleats including multiple individual cleats. Multiple cleats may be molded into a magazine-loadable clip form that is configured to dispense single or multiple cleats. Alternatively, the cleats may be fabricated in an extended linear chain that is configured to be rolled onto a reel, and dispensed from the reel as needed. In one exemplary process, the cleats are manufactured in a form that is readily usable by hand, or that is compatible with assembly equipment that aids in packaging operations.

The size of the disclosed cleats may vary with the scale of the item to be secured, and the size of the packaging materials employed. For smaller items, such as toys, the cleats may be about 10-30 mm in width, about 80-110 mm in length, and the cleat body may be about 1-3 mm in thickness. In a particular embodiment of the disclosed cleat, the cleat is about 90-100 mm in length, about 20 mm in width, has a cleat body that is about 2 mm in thickness, and lugs about 2.5 mm high, with the underside of the cantilevered portion of the lug about 1 mm higher than the upper surface of the cleat body. For securing larger and/or heavier items, the cleats may be larger, perhaps on the order of several centimeters, or larger.

The cleats of the present disclosure may be used in conjunction with one or more pieces of packaging material, in order to secure a packaged item. As used herein, "packaging material" is meant to include any material to which an item is to be secured using a cleat of the present disclosure. Although not required, the packaging material generally includes a surface or portion of a surface that is substantially planar. The packaging material can be used in packaging an item for storage, shipping, or display. The packaging material can be the surface of a box, a backing sheet, an internal partition, or another sufficiently sturdy piece of material.

As used herein, a packaging tie is a flexible fastener that typically includes a metal wire; a metal wire encased in a thin strip of paper, plastic, or other suitable coating; or a plastic strap. Packaging ties may be provided in discrete individual lengths, or dispensed from a roll of continuous coated wire and cut to a desired length, either manually or automatically. Packaging ties may alternatively be referred to as "twist-ties," "flex-ties," or "plas-ties." When used as a fastener, one end of a packaging tie is typically looped back on itself, or crossed over the other end of the same or a different tie, and twisted tightly.

Figure 8:
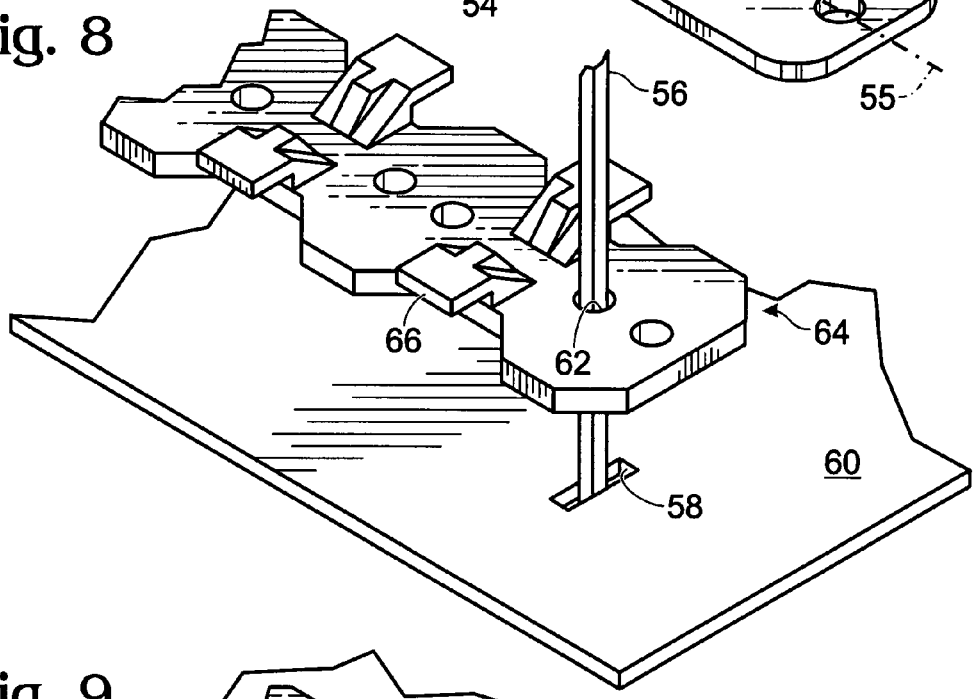
FIG. 8 depicts a partial isometric view of the exemplary cleat of FIGS. 3-5 in combination with a backing, with a packaging tie inserted through the backing and the cleat.
Figure 9:
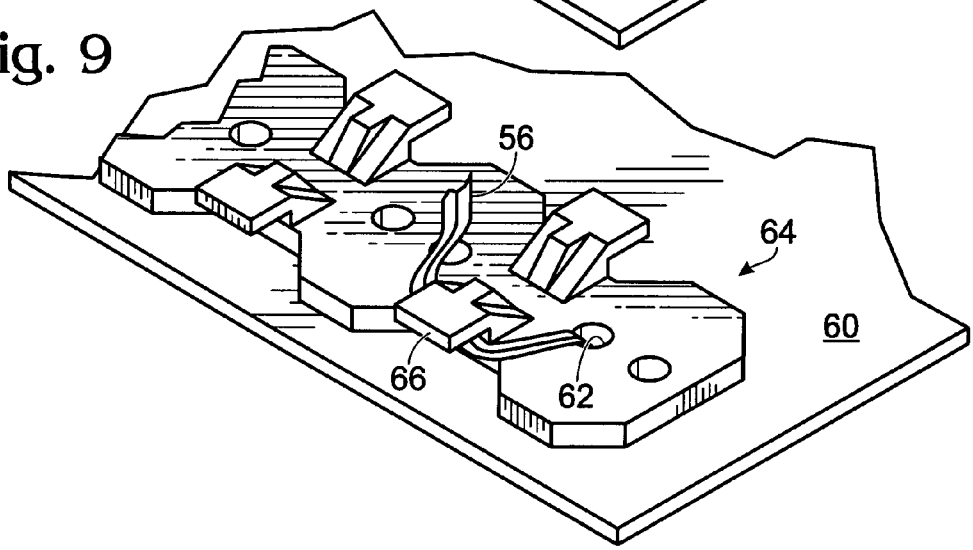
FIG. 9 depicts a partial isometric view of the exemplary cleat of FIG. 8 flush with the backing, and with the packaging tie engaged around an adjacent lug.
Figure 10:
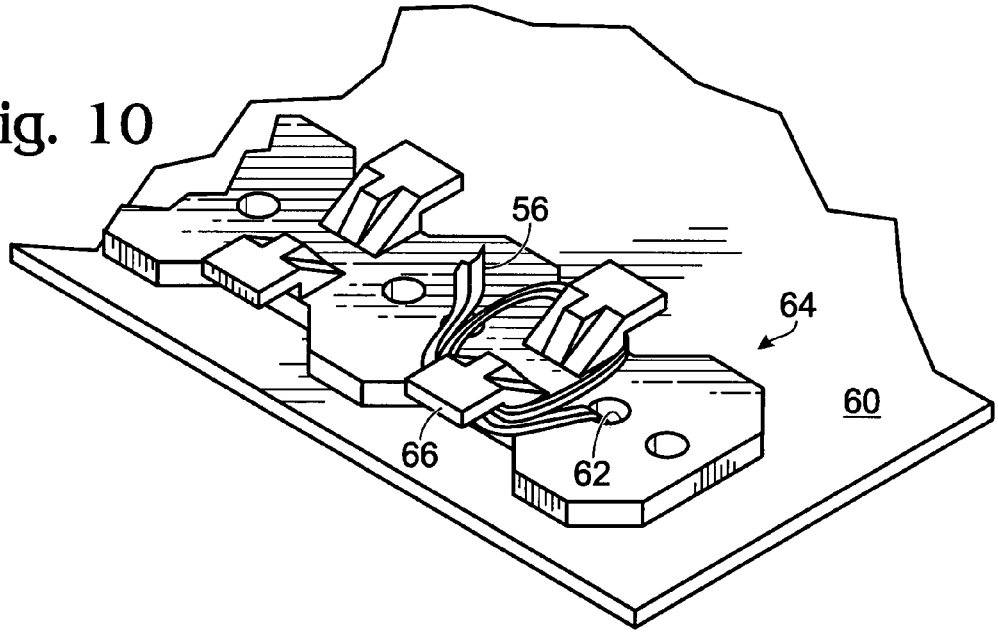
FIG. 10 depicts a partial isometric view of the exemplary cleat of FIGS. 8-9 flush with the backing, and with the packaging tie engaged around a pair of opposing lugs.

As shown in FIG. 8, a first end of a packaging tie 56 can be threaded through an aperture 58 in the desired packaging material 60. The packaging tie 56 can then be threaded through an aperture 62 in a cleat 64 according to the present disclosure, and the cleat pressed firmly against the packaging material 60. The packaging tie can then be tensioned and secured around an adjacent lug 66 on the cleat body, as shown in FIG. 9. At this point, the packaging tie may be secure; however, the tie may be more substantially secured by additionally wrapping the packaging tie beneath a second lug projecting in the opposite direction, as shown in FIG. 10. The packaging tie may be wrapped around the first and second lug, or may be wrapped around the first, the second, and then around the first yet again, as shown. Alternatively, the packaging tie can also be threaded back and forth between multiple opposing lugs in a serpentine fashion. The cleat of the present disclosure typically is configured to permit a variety of alternative patterns for securing a packaging tie beneath one or more lugs, allowing flexibility in accommodating a variety of packaging materials and packaged items. The present illustrations and description should not be considered to limit any aspect of the present invention to a particular method of securing a packaging tie.

Application of the cleat is intuitive and straightforward, and the particular cleat used can have a conformation to match a particular application, or to offer enhanced flexibility both in the orientation and positioning of the cleat, and in permitting multiple individual packaging ties to be secured using a single cleat.

Figure 11:
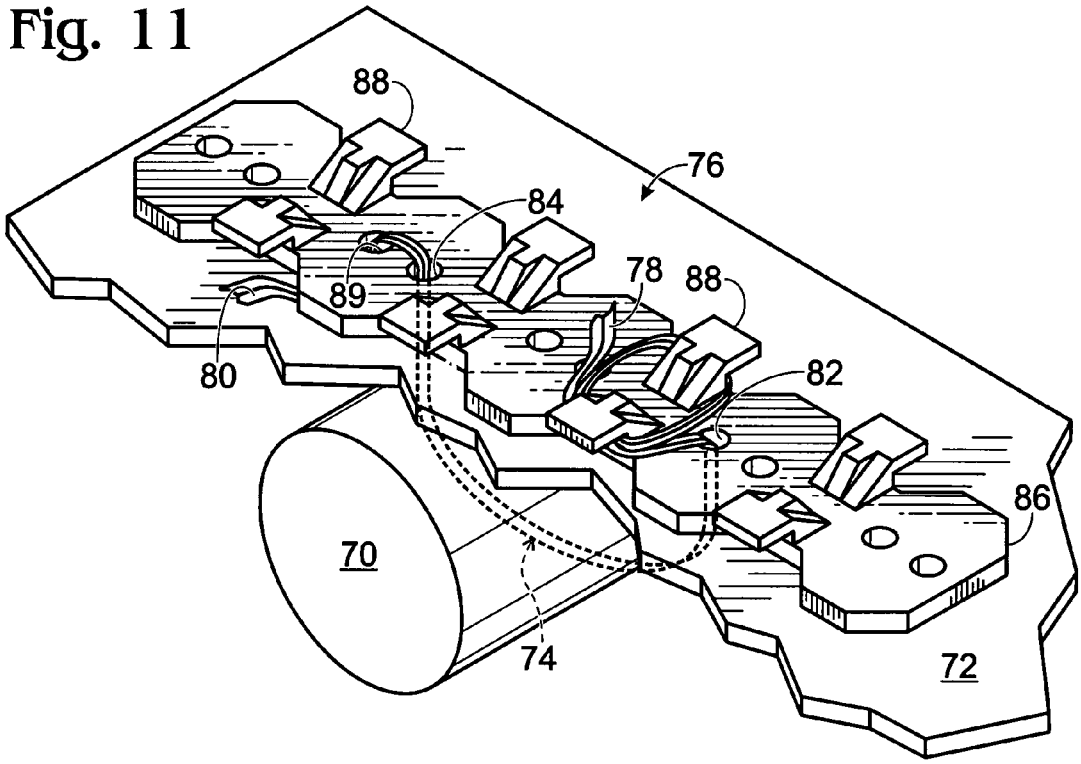
FIG. 11 depicts a partial isometric view of the exemplary cleat of FIGS. 3-5 securing an item against a backing in combination with a packaging tie.

As shown in FIG. 11, an item 70 to be secured against packaging material 72 may be retained by a packaging tie 74 that is engaged at both ends by a cleat 76 of the present disclosure. The packaging tie may be engaged at both ends by a single cleat, or may be engaged by two distinct cleats. Packaged item 70 is secured by a packaging tie 74 having a first end 78 and a second end 80, each of which is threaded upwardly through apertures 82 and 84. Both ends of the packaging tie may be secured by being wrapped around a pair of opposing lugs, or, as shown in FIG. 11, first end 78 may be secured around opposing lugs 88, while second end 80 is secured by being threaded upwardly through a first aperture 84, and then threaded downwardly through a second aperture 89.

Removing a cleat is similarly straightforward, and can be accomplished by even small children. The packaging tie is first disengaged from the lug, and the cleat is then pulled upward from the packaging material. The end of the packaging tie is then free, and it may be pulled free from the opposite side of the packaging material.

Figure 12:
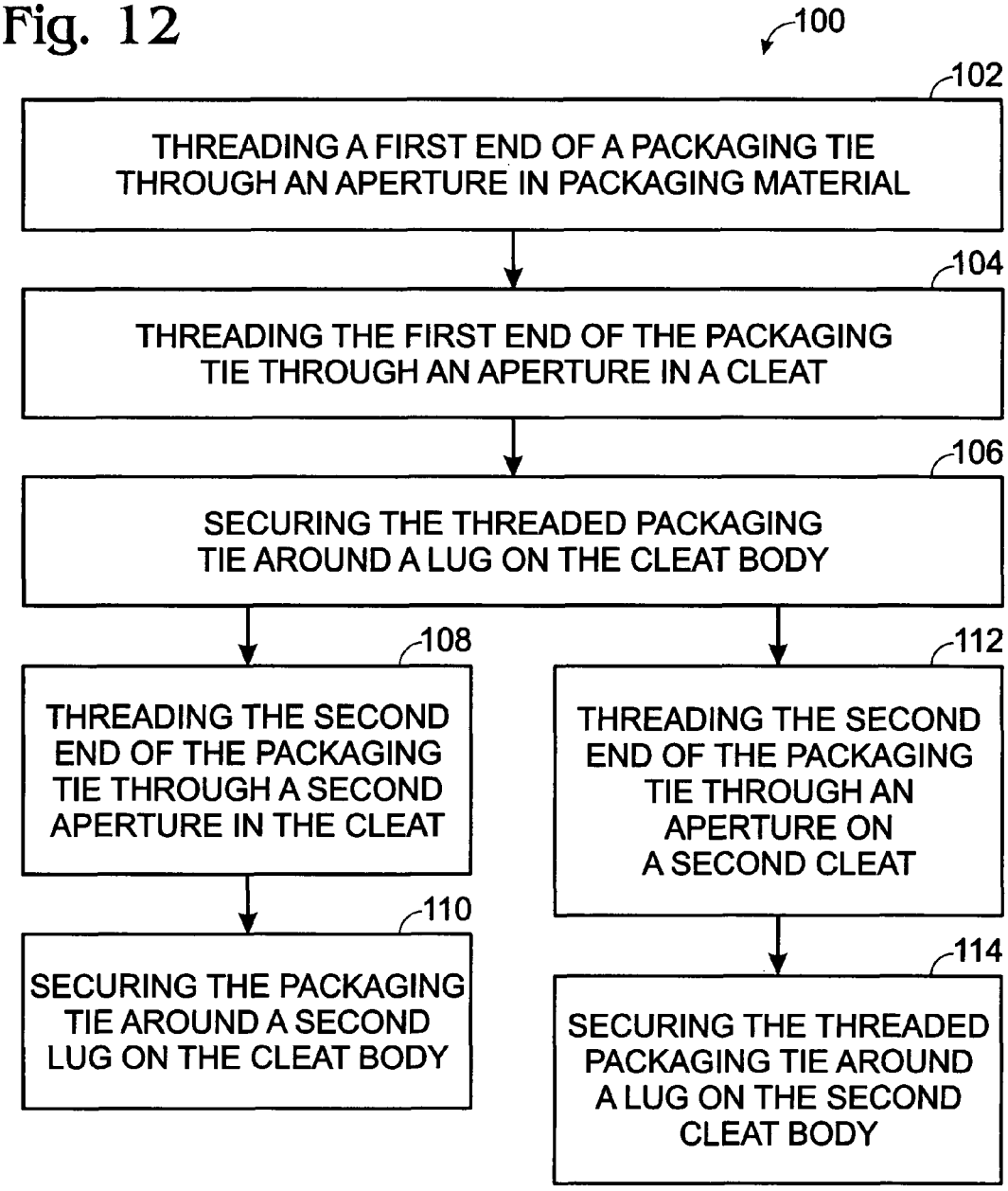
FIG. 12 is a flowchart depicting an exemplary method of securing an item with a cleat of the present disclosure.

The cleats of the present disclosure lend themselves to a method 100 of securing an item to packaging material as shown in FIG. 12, the method including threading a first end of a packaging tie through an aperture in the packaging material at 102, threading the first end of the packaging tie through an aperture in a cleat at 102, and securing the threaded packaging tie around a lug on the cleat body at 106. The method may further include threading the second end of the packaging tie through a second aperture in the cleat at 108, and securing the packaging tie around a second lug on the cleat body at 110. Alternatively, or in addition, the method may further include threading the second end of the packaging tie through an aperture on a second cleat at 112, and securing the threaded packaging tie around a lug on the second cleat body at 114.

The cleats described herein may be used in conjunction with automated or semi-automated methods. For example, multiple cleats may be manufactured in a clip that is configured to be loaded into, and dispensed by, automated or semi-automated assembly equipment.

A variety of items or objects may be secured using the disclosed cleats. Modern packaging often includes blister packs or transparent windows, where it is preferred that the packaged item be retained in an appropriate position and/or orientation for display. Alternatively, or in addition, proper packaging may help prevent damage to the item during shipping. The disclosed cleats are useful for securing a variety of objects and items, and either the cleat, the packaging tie, or both, may be scaled up or down in size as appropriate for the item or object to be secured. In particular, the disclosed cleat is of particular utility when used in conjunction with any of a variety of packaged toys, including for example action figures, figurines, dolls, vehicles, and other toys.

In addition to the advantages of being inexpensively produced and easily applied, the cleats of the present disclosure facilitate the rapid and straightforward removal of packaging. The secured packaging ties may be unwrapped from the cleat, and the cleat removed from the packaging materials with a minimum of effort, and without requiring wirecutters, box knives, or even scissors. The use of the cleats of the present disclosure permits even children to open and unpack their packaged items without assistance.

Although the present invention has been shown and described with reference to the foregoing operational principles and preferred embodiments, it will be apparent to those skilled in the art that various changes in form and detail can be made without departing from the spirit and scope of the invention as defined in the following claims. Various configurations of apertures, lugs, and cleat bodies may be envisioned, as well as a variety of possible interactions between the packaging tie and the apertures and lugs of the cleat. The present invention is intended to embrace all such alternatives, modifications and variances, including all novel and non-obvious combinations and subcombinations of the various elements, features, functions and/or properties disclosed herein.

What is claimed is:

1. A cleat for securing packaging ties, comprising:

an elongate cleat body having an upper surface, a flat undersurface, a periphery having two shorter sides and two longer sides, and having a plurality of concavities along the longer sides of the cleat periphery;

a plurality of apertures in the cleat body; and a plurality of lugs along a perimeter of the upper surface disposed along the longer sides in opposing pairs that project toward opposite sides of the cleat body, each lug having a portion that is cantilevered toward the periphery and projects substantially beyond a corresponding concavity in the adjacent periphery, so that the plurality of lugs is configured to securely and reversibly engage a packaging tie;

wherein the cleat is configured so that a packaging tie can be inserted upwardly through an aperture and secured around a lug.

2. The cleat of claim 1, wherein each pair of opposed lugs is disposed between a pair of adjacent apertures.

3. The cleat of claim 1, wherein the plurality of apertures is disposed along the a longitudinal axis of the cleat.

4. The cleat of claim 1, wherein the plurality of apertures are disposed symmetrically with respect to a vertical plane including a longitudinal axis of the cleat.

5. The cleat of claim 1, wherein the cleat is configured so that the packaging tie is secured by threading the tie upwardly through an aperture and by passing it beneath one or more cantilevered lugs.

6. The cleat of claim 1 wherein the cleat is configured so that the packaging tie is secured by threading the tie upwardly through an aperture and by passing it beneath each of at least two lugs that are members of an opposing pair.

7. The cleat of claim 1, further comprising one or more protrusions on the flat undersurface of the cleat.

8. The cleat of claim 1, further comprising the packaging tie.

9. The cleat of claim 1, wherein the plurality of apertures in the cleat body are disposed along the longitudinal axis of the cleat, the plurality of lugs are symmetrically disposed with respect to a vertical plane including a longitudinal axis of the cleat in opposing pairs that project toward opposite sides of the cleat body, each lug is cantilevered toward the outer periphery of the cleat body, and each lug is disposed adjacent to an aperture.

10. The cleat of claim 1, where the cleat is mirror-symmetric with respect to a plane perpendicular to a longitudinal axis of the cleat.

11. The cleat of claim 1, wherein the plurality of apertures is disposed along a longitudinal axis of the cleat, the plurality of apertures are disposed symmetrically with respect to a vertical plane including the longitudinal axis of the cleat, and each pair of opposed lugs is disposed between a pair of adjacent apertures.

* * * * *